US011008813B2

(12) United States Patent
Hough et al.

(10) Patent No.: US 11,008,813 B2
(45) **Date of Patent: *May 18, 2021**

(54) SYSTEM AND METHODOLOGY FOR DRILLING

(71) Applicant: Schlumberger Technology Corporation, Sugar Land, TX (US)

(72) Inventors: Steven Hough, Stonehouse (GB); Katharine L. Mantle, Stonehouse (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/538,000

(22) Filed: Aug. 12, 2019

(65) Prior Publication Data

US 2019/0360275 A1 Nov. 28, 2019

Related U.S. Application Data

(62) Division of application No. 14/700,195, filed on Apr. 30, 2015, now Pat. No. 10,378,286.

(51) Int. Cl.

| | |
|---|---|
| ***E21B 10/42*** | (2006.01) |
| ***E21B 47/01*** | (2012.01) |
| ***E21B 47/024*** | (2006.01) |

(52) U.S. Cl.

CPC ..... *E21B 10/42* (2013.01); *E21B 47/01* (2013.01); *E21B 47/024* (2013.01)

(58) Field of Classification Search

CPC ..... E21B 10/42; E21B 47/01; E21B 47/013; E21B 47/024

See application file for complete search history.

(56) References Cited

U.S. PATENT DOCUMENTS

| | | | | |
|---|---|---|---|---|
| 4,875,014 | A * | 10/1989 | Roberts | E21B 47/13 324/326 |
| 5,113,953 | A | 5/1992 | Noble | |
| 5,265,682 | A | 11/1993 | Russell et al. | |
| 5,368,109 | A * | 11/1994 | Pittard, Jr. | E21B 4/02 175/107 |
| 5,520,255 | A | 5/1996 | Barr et al. | |
| 5,553,678 | A * | 9/1996 | Barr | E21B 47/01 175/73 |
| 5,553,679 | A | 9/1996 | Thorp | |

(Continued)

OTHER PUBLICATIONS

International Search Report and Written Opinion issued in International Patent application PCT/US2016/028020, dated Jul. 28, 2016. 12 pages.

(Continued)

*Primary Examiner* — Matthew R Buck

(57) ABSTRACT

A technique facilitates a drilling operation by providing a drill bit having limited magnetic influence. The drill bit comprises a bit head formed with a non-magnetic bit head material. Cutting elements may be attached to the bit head to facilitate cutting of rock and other formation material during drilling of a borehole. The drill bit also comprises a bit body formed with a non-magnetic body material. The bit head and the bit body are joined to construct a non-magnetic drill bit which has no or limited magnetic influences on, for example, sensors located proximate the drill bit.

8 Claims, 2 Drawing Sheets

(56) References Cited

U.S. PATENT DOCUMENTS 5,582,259 A 12/1996 Barr
5,585,726 A * 12/1996 Chau ..... G01V 3/26 324/326
5,603,385 A 2/1997 Colebrook
5,673,763 A 10/1997 Thorp
5,685,379 A 11/1997 Barr et al.
5,695,015 A 12/1997 Barr et al.
5,706,905 A 1/1998 Barr
5,778,992 A 7/1998 Fuller
5,803,185 A 9/1998 Barr et al.
5,971,085 A 10/1999 Colebrook
6,089,332 A 7/2000 Barr et al.
6,092,610 A 7/2000 Kosmala et al.
6,158,529 A 12/2000 Dorel
6,244,361 B1 6/2001 Comeau et al.
6,364,034 B1 4/2002 Schoeffler
6,394,193 B1 5/2002 Askew
8,307,914 B2 * 11/2012 Pafitis ..... E21B 7/064 175/61
8,312,941 B2 * 11/2012 Mirchandani ..... E21B 10/00 175/327
8,360,172 B2 * 1/2013 Santelmann ..... E21B 7/067 175/61
8,469,117 B2 * 6/2013 Pafitis ..... E21B 7/064 175/61
9,312,941 B2 4/2016 Soriaga et al.
9,624,729 B2 * 4/2017 Sullivan ..... E21B 12/02
9,695,642 B2 * 7/2017 Hay ..... E21B 47/0228
10,378,286 B2 * 8/2019 Hough ..... E21B 10/42
2001/0052428 A1 12/2001 Larronde et al.
2002/0011359 A1 1/2002 Webb et al.
2005/0199425 A1 * 9/2005 Estes ..... G01V 3/26 175/50
2006/0090935 A1 * 5/2006 Van Steenwyk ..... E21B 7/068 175/73
2009/0301789 A1 * 12/2009 Smith ..... B22F 3/1017 175/374
2010/0252327 A1 * 10/2010 Beuershausen ..... E21B 10/26 175/57
2012/0193148 A1 * 8/2012 Overstreet ..... B23K 31/025 175/320
2014/0138157 A1 * 5/2014 Heisig ..... E21B 10/08 175/40
2015/0330154 A1 * 11/2015 Pearce ..... E21B 10/48 175/425
2016/0003029 A1 * 1/2016 Hay ..... E21B 17/00 702/7
2016/0298448 A1 * 10/2016 Heisig ..... E21B 7/068
2017/0328143 A1 * 11/2017 Ang ..... E21B 47/01
2018/0016848 A1 * 1/2018 Kumar ..... B24D 99/005

OTHER PUBLICATIONS

International Preliminary Report on Patentability issued in International Patent application PCT/US2016/028020, dated Nov. 9, 2017. 9 pages.

* cited by examiner

SYSTEM AND METHODOLOGY FOR DRILLING

CROSS REFERENCE TO RELATED APPLICATION

This application is a divisional application of U.S. application Ser. No. 14/700,195, filed Apr. 30, 2015, which is incorporated herein by reference in its entirety.

BACKGROUND

In many hydrocarbon well applications, a wellbore is drilled into a desired hydrocarbon-bearing formation. The drilling may be performed by cutting elements of a drilling tool forming part of a bottom hole assembly located in a drill string. When drilling deviated wellbores, the direction of drilling may be controlled by a steering system, such as a rotary steerable system. Electronics are disposed in a rotary steerable system control unit or in a measurement-while-drilling tool sensor package and may include several sensors used to measure the trajectory and attitude of the drilling tool at a given point in space. At least some of the sensors comprise magnetometers which are sensitive to the Earth's magnetic field and also to external magnetic influences, including metal above and below the sensors in the bottom hole assembly. The magnetic interference from drill string influences is calculated prior to the drilling job and an estimated error is determined. The estimated error may be reduced by providing a large distance between the drill bit and the magnetometer sensors. However, the large distance limits the type and accuracy of the data which may be obtained.

SUMMARY

In general, a system and methodology provide a drill bit having limited magnetic influence. The drill bit comprises a bit head formed with a non-magnetic bit head material to which cutting elements may be attached. The drill bit also comprises a bit body formed with a non-magnetic body material. The bit head and the bit body are joined to construct a non-magnetic drill bit which has no or limited magnetic influences on, for example, sensors located proximate the drill bit.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
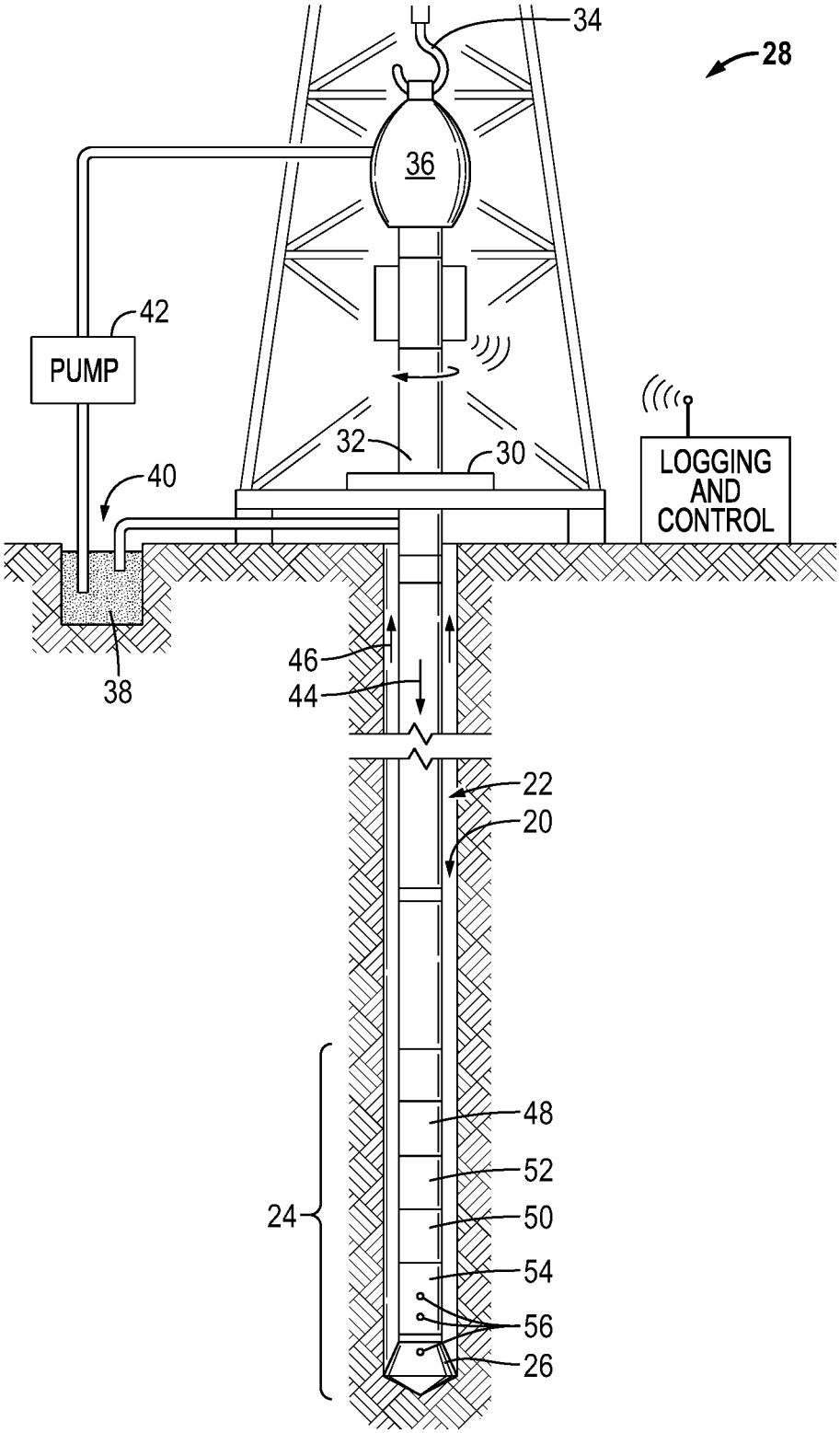
FIG. 1 is a schematic view of an example of a well system having a drill string deployed in a wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

With respect to certain embodiments of the present disclosure, a system and methodology are provided to facilitate a drilling operation, such as a deviated borehole drilling operation. The directional drilling is facilitated by utilizing a drill bit having limited magnetic influence. In this example, the drill bit comprises a bit head formed with a non-magnetic bit head material. Cutting elements may be attached to the bit head in a suitable pattern to facilitate cutting of rock or other material during drilling of a borehole. The drill bit also comprises a bit body formed with a non-magnetic body material. The bit head and the bit body are joined to construct a non-magnetic drill bit which has no or limited magnetic influences on, for example, sensors located proximate the drill bit.

By way of example, the drill bit may be constructed with non-magnetic materials and combined with magnetometer sensors proximate the drill bit to enable greater accuracy of wellbore surveying. In an embodiment, a magnetometer sensor or sensors may be placed within the drill bit and/or within a component adjacent the drill bit. The drill bit may comprise various non-magnetic materials. For example, a bit head of the drill bit may be formed from tungsten carbide, e.g. infiltrated tungsten carbide, or non-magnetic steel. A bit head body section also may be formed of a non-magnetic material, such as non-magnetic steel. A variety of cutting elements may be attached to the bit head by suitable fasteners, e.g. threaded fasteners, or by other attachment mechanisms, such as welding. The cutting elements may be in the form of polycrystalline diamond compacts or tungsten carbide cutting elements.

For a variety of applications, the drill bit may be used in combination with different types of sensors selected according to parameters of the drilling operation. For example, such sensors may comprise magnetometer sensors positioned to measure the Earth's magnetic field and the drill bits orientation relative to the Earth's magnetic field. One or more of the magnetometer sensors may be located in the drill bit. However, the magnetometer sensors also may be located at other locations proximate the drill bit, e.g. within a component adjacent the drill bit. Additionally, the drill bit may be used in combination with other types of sensors, including at least one accelerometer used to, for example, measure the Earth's gravitational field and the relative angle of the drilling tool including the drill bit. The sensors also may comprise at least one gyro used to, for example, measure the Earth's rotational axis and the relative angle and rotational speed of the drill bit.

By constructing the drill bit with non-magnetic materials, the magnetic interference otherwise introduced by the materials of a conventional drill bit is reduced or eliminated. This non-magnetic construction enables placement of the magnetometer sensor or sensors proximate the drill bit. In some applications, the magnetometer sensor or sensors may be placed within the drill bit itself. The proximity of the sensors to the drill bit enables increased accuracy of real-time detection of drill bit approach to magnetic anomalies and also enables substantially improved collection of drilling trajectory data.

Referring generally to FIG. 1, an example of a wellsite system is illustrated in which embodiments described herein may be employed. The wellsite may be onshore or offshore. In a wellsite system, a borehole 20 is formed in subsurface formations by drilling. The method of drilling to form the borehole 20 may include, but is not limited to, rotary and directional drilling. A drill string 22 is suspended within the borehole 20 and has a bottom hole assembly (BHA) 24 that includes a drill bit 26 at its lower end.

An embodiment of a surface system includes a platform and derrick assembly 28 positioned over the borehole 20. An example of assembly 28 includes a rotary table 30, a kelly 32, a hook 34 and a rotary swivel 36. The drill string 22 is rotated by the rotary table 30, energized by a suitable system (not shown) which engages the kelly 32 at the upper end of the drill string 22. The drill string 22 is suspended from the hook 34, attached to a traveling block (not shown) through the kelly 32 and the rotary swivel 36 which permits rotation of the drill string 22 relative to the hook 34. A top drive system could be used in other embodiments.

An embodiment of the surface system also includes a drilling fluid 38, e.g., mud, stored in a pit 40 formed at the wellsite. A pump 42 delivers the drilling fluid 38 to the interior of the drill string 22 via one or more ports in the swivel 36, causing the drilling fluid to flow downwardly through the drill string 22 as indicated by directional arrow 44. The drilling fluid exits the drill string 22 via one or more ports in the drill bit 26, and then circulates upwardly through the annulus region between the outside of the drill string 22 and the wall of the borehole, as indicated by directional arrows 46. In this manner, the drilling fluid lubricates the drill bit 26 and carries formation cuttings and particulate matter up to the surface as it is returned to the pit 40 for recirculation.

The illustrated embodiment of bottom hole assembly 24 includes one or more logging-while-drilling (LWD) modules 48/50, one or more measuring-while-drilling (MWD) modules 52, one or more roto-steerable systems and motors (not shown), and the drill bit 26. It will also be understood that more than one LWD module and/or more than one MWD module may be employed in various embodiments, e.g. as represented at 48 and 50.

The LWD module 48/50 is housed in a type of drill collar, and includes capabilities for measuring, processing, and storing information, as well as for communicating with the surface equipment. The LWD module 48/50 also may include a pressure measuring device and one or more logging tools.

The MWD module 52 is also housed in a type of drill collar, and includes one or more devices for measuring characteristics of the drill string 22 and drill bit 26. The MWD module 52 also may include one or more devices for generating electrical power for the downhole system. In an embodiment, the power generating devices include a mud turbine generator (also known as a "mud motor") powered by the flow of the drilling fluid. In other embodiments, other power and/or battery systems may be employed to generate power.

The MWD module 52 also may include one or more of the following types of measuring devices: a weight-on-bit measuring device, a torque measuring device, a vibration measuring device, a shock measuring device, a stick slip measuring device, a direction measuring device, and an inclination measuring device.

In an operational example, the wellsite system of FIG. 1 is used in conjunction with controlled steering or "directional drilling." Directional drilling is the intentional deviation of the wellbore from the path it would naturally take. In other words, directional drilling is the steering of the drill string 22 so that it travels in a desired direction. Directional drilling is, for example, useful in offshore drilling because it enables multiple wells to be drilled from a single platform. Directional drilling also enables horizontal drilling through a reservoir. Horizontal drilling enables a longer length of the wellbore to traverse the reservoir, which increases the production rate from the well.

A directional drilling system also may be used in vertical drilling operation. Often the drill bit will veer off of a planned drilling trajectory because of the unpredictable nature of the formations being penetrated or the varying forces that the drill bit experiences. When such a deviation occurs, a directional drilling system may be used to put the drill bit back on course.

A known method of directional drilling includes the use of a rotary steerable system ("RSS"). In an embodiment that employs the wellsite system of FIG. 1 for directional drilling, a steerable tool or subsystem 54 is provided. In an RSS, the drill string may be rotated from the surface, and downhole devices cause the drill bit to drill in the desired direction. Rotating the drill string greatly reduces the occurrences of the drill string getting hung up or stuck during drilling. Rotary steerable drilling systems for drilling deviated boreholes into the earth may be generally classified as either "point-the-bit" systems or "push-the-bit" systems.

In an example of a "point-the-bit" rotary steerable system, the axis of rotation of the drill bit is deviated from the local axis of the bottom hole assembly in the general direction of the new hole. The hole is propagated in accordance with the customary three-point geometry defined by upper and lower stabilizer touch points and the drill bit. The angle of deviation of the drill bit axis coupled with a finite distance between the drill bit and lower stabilizer results in the non-collinear condition for a curve to be generated. This may be achieved in a number of different ways, including a fixed bend at a point in the bottom hole assembly close to the lower stabilizer or a flexure of the drill bit drive shaft distributed between the upper and lower stabilizer. In its idealized form, the drill bit does not have to cut sideways because the bit axis is continually rotated in the direction of the curved hole. Examples of "point-the-bit" type rotary steerable systems and their operation are described in U.S. Pat. Nos. 6,394,193; 6,364,034; 6,244,361; 6,158,529; 6,092,610; and 5,113,953; and U.S. Patent Application Publication Nos. 2002/0011359 and 2001/0052428.

In an example of a "push-the-bit" rotary steerable system, there is no specially identified mechanism that deviates the bit axis from the local bottom hole assembly axis. Instead, the requisite non-collinear condition is achieved by causing either or both of the upper or lower stabilizers to apply an eccentric force or displacement in a direction that is oriented with respect to the direction of hole propagation. This may be achieved in a number of different ways, including non-rotating (with respect to the hole) eccentric stabilizers (displacement based approaches) and eccentric actuators that apply force to the drill bit in the desired steering direction. Steering is achieved by creating non co-linearity between the drill bit and at least two other touch points. In its idealized form, the drill bit does not have to cut sideways to generate a curved hole. Examples of "push-the-bit" type rotary steerable systems and their operation are described in U.S. Pat. Nos. 6,089,332; 5,971,085; 5,803,185; 5,778,992; 5,706,905; 5,695,015; 5,685,379; 5,673,763; 5,603,385; 5,582,259; 5,553,679; 5,553,678; 5,520,255; and 5,265,682.

In the illustrated example, drill bit 26 is constructed from non-magnetic materials as described in greater detail below. The non-magnetic materials facilitate placement of a variety of sensors 56 in close proximity to the drill bit 26. For example, the sensors 56 may comprise at least one and often a plurality of magnetometer sensors located proximate the drill bit 26. In some applications at least one magnetometer sensor 56 may be located within the drill bit 26 and/or at least one magnetometer sensor 56 may be located in an adjacent component, e.g. subsystem 54, to provide sensing close to the drill bit 26.

Figure 2:
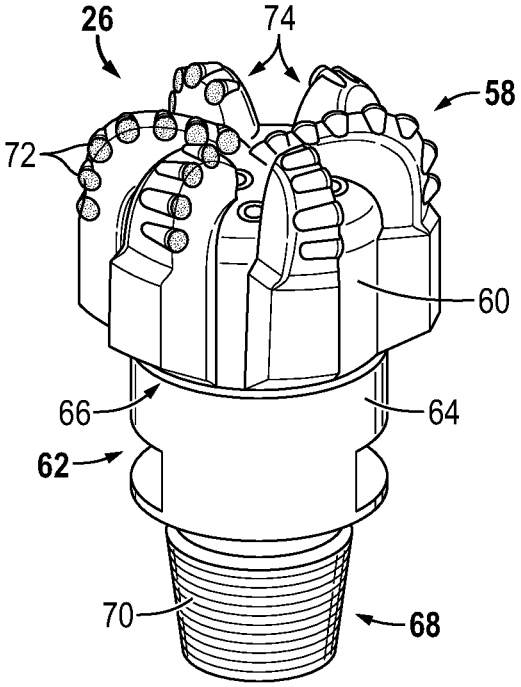
FIG. 2 is an orthogonal view of a non-magnetic drill bit, according to an embodiment of the disclosure.

Referring generally to FIG. 2, an example of non-magnetic drill bit 26 is illustrated. In this example, drill bit 26 comprises a bit head 58 formed of a non-magnetic bit head material 60. Additionally, the illustrated drill bit 26 comprises a bit body section 62 formed of a non-magnetic body material 64. The bit body section 62 may be coupled with the bit head 58 via a suitable fastening mechanism, such as a threaded engagement region 66. The threaded engagement region 66 allows bit head 58 to be threaded onto bit body section 62. For example, the threaded engagement region 66 may comprise a pin thread on bit body section 62 and a corresponding box thread within bit head 58 for threadably receiving the pin thread of bit body section 62. The bit body section 62 also may comprise a drill string engagement section 68 by which the drill bit 26 is coupled into drill string 22. In the illustrated example, drill string engagement section 68 comprises a threaded pin section 70 which may be threadably engaged with a corresponding threaded box section of the drill string 22.

In the illustrated embodiment, drill bit 26 further comprises a plurality of cutting elements 72. The cutting elements 72 may be mounted on blades 74 and/or other features of bit head 58. By way of example, the cutting elements 72 may be in the form of polycrystalline diamond compacts or tungsten carbide cutting elements. Depending on the drilling application, the cutting elements 72 may be attached to bit head 58 via a variety of fastening mechanisms, including separate fasters, brazing, welding, and/or other suitable fastening mechanisms.

The non-magnetic bit head material 60 and the non-magnetic body material 64 provide an overall drill bit 26 which is non-magnetic or substantially non-magnetic. By way of example, the bit head 58 of drill bit 26 may be constructed with non-magnetic bit head material 60 in the form of tungsten carbide, e.g. infiltrated tungsten carbide, or non-magnetic steel. Similarly, the bit head body section 62 may be constructed with non-magnetic body material 64 in the form of non-magnetic steel and/or other suitable non-magnetic materials, e.g. tungsten carbide. In some applications, the drill bit 26 can be constructed by sintering a matrix structure with a non-magnetic steel blank disposed in a mold. The threaded pin section 70 is then machined; or the matrix structure may be welded or otherwise attached to the threaded pin section 70.

Figure 3:
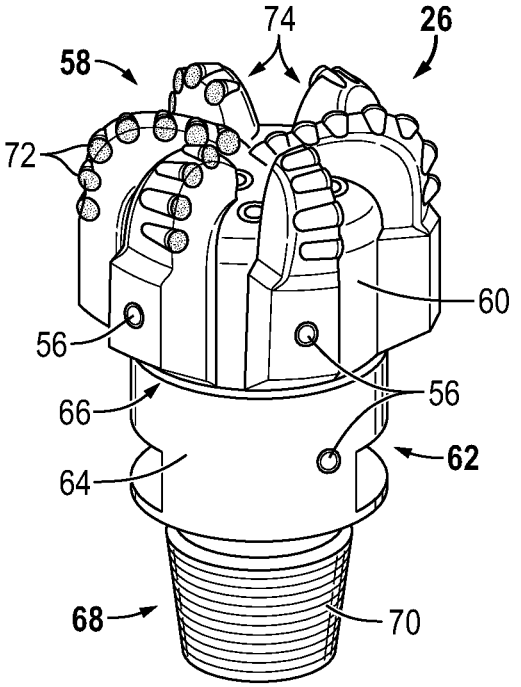
FIG. 3 is an orthogonal view of a non-magnetic drill bit having sensors incorporated into the drill bit, according to an embodiment of the disclosure.

In the embodiment illustrated in FIG. 2, sensors 56, e.g magnetometer sensors, may be placed proximate drill bit 26. For example, the magnetometer sensors 56 may be placed in a component adjacent to drill bit 26, such as the adjacent subsystem 54 illustrated in FIG. 1. However, sensors 56 also may be located in drill bit 26, as illustrated in FIG. 3. By way of example, sensors 56, e.g. magnetometer sensors, may be located in bit head 58 and/or bit body section 62. In a variety of drilling applications, placement of magnetometer sensors 56 within drill bit 26 provides greater accuracy of wellbore surveying.

Figure 4:
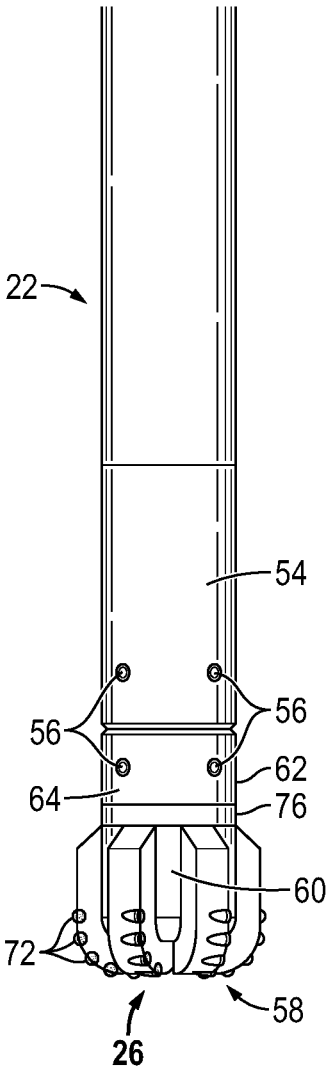
FIG. 4 is a front view of another example of a non-magnetic drill bit, according to an embodiment of the disclosure.

Referring generally to FIG. 4, another embodiment of drill bit 26 is illustrated. In this embodiment, the drill bit 26 is constructed as a three-piece structure. In some applications, a non-magnetic bit body section 62, e.g. a non-magnetic steel bit body section, and a threaded pin section 70 can be attached to non-magnetic bit head 58 after sintering a separate cutting structure. In this example, the non-magnetic bit head 58 may be formed with a matrix structure comprising non-magnetic material 60 in the form of tungsten carbide or another suitable non-magnetic material.

A locking ring 76 may be employed for attachment of the non-magnetic bit body section 62 to the non-magnetic bit head 58. In some applications, the locking ring 76 is constructed with a series of protuberances or other features which engage corresponding features on non-magnetic bit head 58 to rotationally lock bit head 58 with locking ring 76. The locking ring 76 may then be affixed to bit body section 62 via suitable fastening techniques, such as threaded engagement, welding, brazing, and/or other suitable fastening techniques. In this example, magnetometer sensors 56 and/or other sensors 56 may be mounted within drill bit 26 and/or proximate drill bit 26. For example, sensors 56 can be mounted in a component, e.g. component 54, adjacent drill bit 26.

The non-magnetic drill bit 26 in combination with near drill bit or in drill bit magnetometers 56 can be used to generate a definitive wellbore survey very close to the drill bit 26. The definitive wellbore survey is generated without suffering magnetic interference that would otherwise be generated by a magnetic, steel bodied drill bit. The combination of non-magnetic drill bit 26 with close proximity sensors 56 provides increased accuracy in surveying and thus enables drilling of a greater density of wellbores in a given area. For example, a greater density of wellbores may be drilled and used in unconventional "pad" or "factory drilling" developments.

The combination of non-magnetic drill bit 26 with close proximity sensors 56 further facilitates accurate wellbore positioning and repeatability which enables improved side-tracking and/or drilling of relief wells. Similarly, the non-magnetic drill bit 26 in combination with close proximity sensors 56, e.g. magnetometer sensors, enables improved reservoir characterization. For example, the system enables improved reservoir characterization in extended reach well applications. Conventionally, extended reach wells create the greatest geographic uncertainty at the toe of the well because of cumulative errors from each survey station. The use of a non-magnetic drill bit 26 with close proximity sensors 56 reduces this geographic uncertainty and improves the reservoir characterization.

In a variety of applications, the non-magnetic drill bit 26 further enables increased accuracy of real-time detection of magnetic anomalies as the drill bit approaches magnetic anomalies. Examples of such magnetic anomalies include wellbore casings in different wellbores or fishing equipment in another well. With sensors 56 placed proximate drill bit 26, more accurate direction and inclination measurements are enabled and this capability removes the lag time otherwise experienced with some rotary steerable tools. The reduction in lag time reduces, for example, undesirable oscillatory effects. Such a reduction in lag time also can be used to improve the operation of automated closed loop systems. With automated closed loop systems, the ability to use magnetometer sensors 56 proximate the drill bit 26 reduces or eliminates control programming otherwise used to predict ahead of the drill bit 26.

More accurate direction and inclination measurements close to drill bit 26 also removes a substantial amount of the guesswork and/or operator skill employed in conventional wellbore steering. Consequently, the combination of non-magnetic drill bit 26 and proximate sensors 56 enables drilling operations with less highly trained personnel or with the same number of personnel monitoring a greater number of wells/drilling operations with increased certainty. Similarly, the combination enables simplified control system. For example, the combination enables surface automation and/or computer control of trajectory steering without utilizing complex, predict-ahead algorithms.

Depending on the parameters of a given application, the drill bit 26 may have a variety of sizes, shapes and configurations. Similarly, various patterns and types of cutting elements may be used on the drill bit and may be selected according to the parameters of a given drilling application. The drill bit 26 also may be formed as a unitary structure or as a combination of cooperating structures coupled into a drill string by a suitable engagement mechanism. The non-magnetic material from which drill bit 26 is constructed may comprise a single material, a combination of materials, and/or various matrix materials suitable for a specific drilling operation. In some applications, the drill bit 26 is formed completely from non-magnetic material, although other applications may utilize non-magnetic materials to form a substantial portion of the drill bit structure.

Similarly, drill string 22 may comprise a variety of components and configurations. In some applications, the drill string 22 is rotated from the surface and drill bit 26 is rotated directly by the drill string 22. In other applications, the drill bit 26 may be rotated by a downhole motor. However, rotation also may be provided both from the surface and by a downhole motor. Additionally, the drill bit may be coupled with a variety of steerable systems, such as the push-the-bit and point-the-bit systems described above.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a drill string having a drill bit, the drill bit comprising:

a plurality of fixed blades formed of a non-magnetic material;

a plurality of cutting elements connected to at least one of the plurality of fixed blades; and a magnetometer sensor placed within at least one blade of the plurality of fixed blades of the drill bit.

2. The system as recited in claim 1, wherein the non-magnetic material comprises tungsten carbide.

3. The system as recited in claim 1, wherein the non-magnetic material comprises non-magnetic steel.

4. The system as recited in claim 2, wherein the non-magnetic material comprises infiltrated tungsten carbide.

5. The system as recited in claim 1, wherein at least one of the cutting elements of the plurality of cutting elements is a polycrystalline diamond compact.

6. The system as recited in claim 1, wherein at least one of the cutting elements of the plurality of cutting elements is formed of tungsten carbide.

7. The system as recited in claim 1, wherein the drill string further comprises at least one accelerometer.

8. The system as recited in claim 1, wherein the drill string further comprises at least one gyro.

* * * * *